US005220778A

United States Patent [19]

Flachmueller et al.

[11] Patent Number: 5,220,778

[45] Date of Patent: Jun. 22, 1993

[54] METHOD AND APPARATUS FOR PRODUCING UNTWISTED YARN FROM AT LEAST TWO FIBRIL BUNDLES POSITIONED CONSTANTLY RELATIVE TO ONE ANOTHER

[75] Inventors: Werner Flachmueller, Rickenbach; Hans-Joach Weiss, Ulisbach, both of Switzerland

[73] Assignee: Rieter Machine Works, Ltd., Winterthur, Switzerland

[21] Appl. No.: 902,536

[22] Filed: Jun. 22, 1992

Related U.S. Application Data

[63] Continuation of Ser. No. 619,754, Nov. 28, 1990, abandoned.

[30] Foreign Application Priority Data

Dec. 18, 1989 [CH] Switzerland ..... 4531/89

[51] Int. Cl.[5] ..... D01H 13/30; D02G 1/04

[52] U.S. Cl. ..... 57/333; 57/309

[58] Field of Search ..... 57/333, 309, 352, 350, 57/296, 351, 90; 28/258, 233, 220; 264/103; 118/216

[56] References Cited

U.S. PATENT DOCUMENTS

| | | | |
|---|---|---|---|
| 3,380,131 | 4/1968 | Gray | 28/283 X |
| 3,384,944 | 5/1968 | Madeiros | 28/1 |
| 3,421,926 | 1/1969 | Davies et al. | 118/216 |
| 3,467,062 | 9/1969 | Bridges et al. | 118/216 |
| 3,531,368 | 9/1970 | Okamato et al. | 57/140 X |
| 3,555,808 | 1/1971 | Gutmann, Jr. | 57/333 X |
| 3,711,898 | 1/1973 | Debbas | 28/100 X |
| 3,775,958 | 12/1973 | Lloyd et al. | 57/77.3 |
| 3,780,516 | 12/1973 | Kimbrell | 57/310 |
| 3,781,953 | 1/1974 | Stegelman | 57/90 X |
| 3,971,685 | 4/1976 | Hurtes | 28/160 X |
| 4,025,595 | 5/1977 | Mirhej | 264/103 |
| 4,164,841 | 8/1979 | Borenstein | 57/350 |
| 4,229,404 | 8/1980 | Hatcher et al. | 57/352 X |
| 4,293,518 | 10/1981 | Bethay | 264/210.2 |
| 4,307,497 | 12/1981 | Drummond | 57/333 X |
| 4,408,376 | 8/1983 | Hatcher et al. | 57/310 X |

*Primary Examiner*—Daniel P. Stodola
*Assistant Examiner*—John Rollins
*Attorney, Agent, or Firm*—Francis C. Hand

[57] ABSTRACT

A method for the production of untwisted yarns from at least two fibril bundles. Intermediate method steps, which are introduced between the main steps of the conventional production method for such yarns (Spinning, stretching and texturing), allows the receiprocal position of the individual fibril bundles resulting from the arrangement of the spinnerets to be retained through the process. A non-positively acting false twister for each individual fibril bundle, whose strength or thickness can be varied, also makes it possible to reproducibly vary the mixing of the fibrils of the individual bundles in their contact zones.

11 Claims, 3 Drawing Sheets

Figure 1:
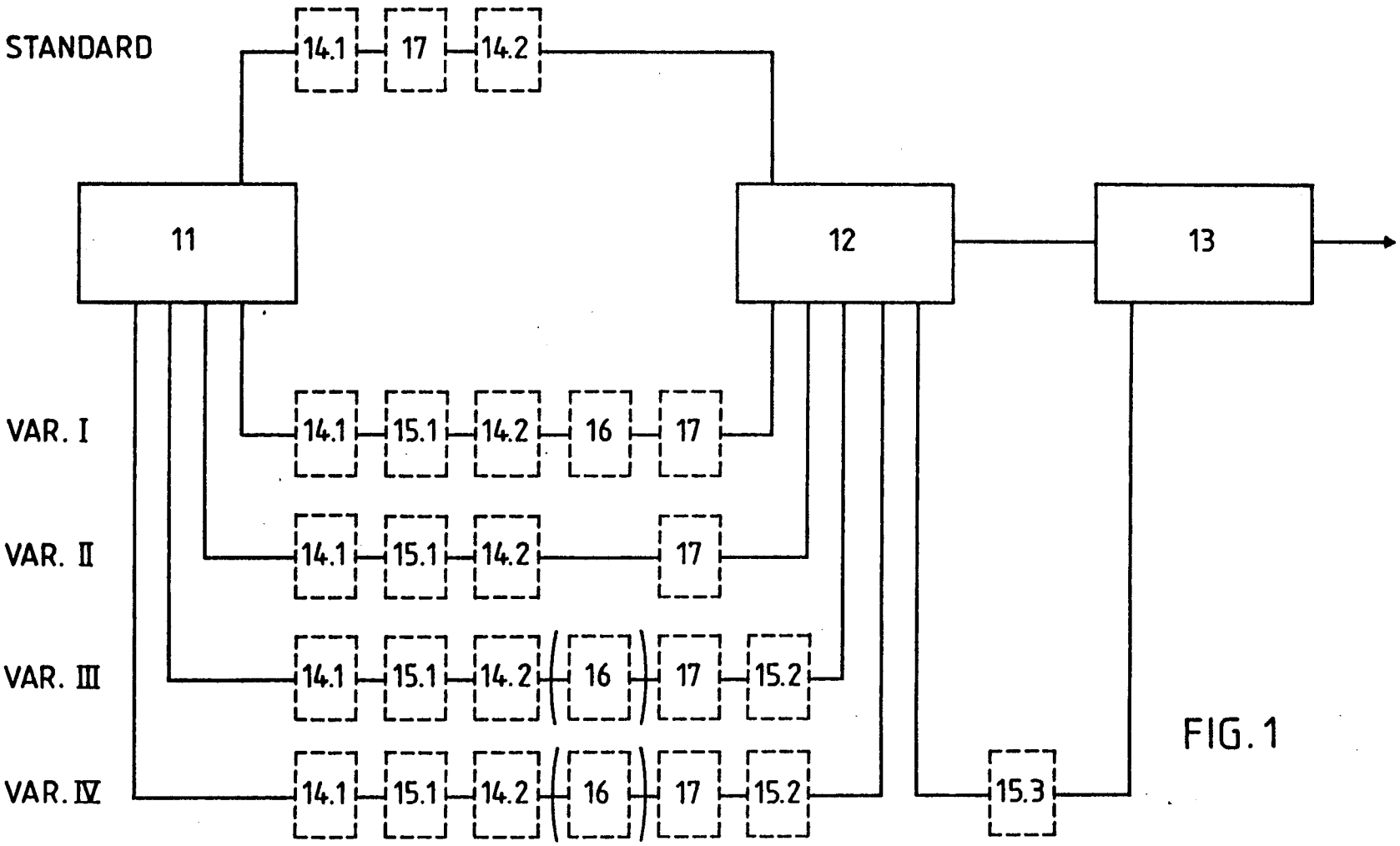

METHOD AND APPARATUS FOR PRODUCING UNTWISTED YARN FROM AT LEAST TWO FIBRIL BUNDLES POSITIONED CONSTANTLY RELATIVE TO ONE ANOTHER

This is a continuation of application Ser. No. 07/619,754 filed on Nov. 28, 1990, now abandoned.

This invention relates to a method and apparatus for producing untwisted yarn from at least two fibril bundles.

Heretofore, various types of techniques have been known for the production of untwisted yarns from at least two fibril bundles. In some cases, the techniques have employed individual steps which are interposed between the spinning and stretching of the fibril bundles or between the stretching and texturing of the fibril bundles.

Where two or more bundles of continuous synthetic fibrils are continuously processed to untwisted yarns, it has been known that between the steps of spinning and stretching or between stretching and texturing (e.g. a gas-dynamic compressive crimping process) they are brought together and optionally actively mixed, e.g. in that they pass through an air jet. Unless special precautions are taken on bringing together and mixing, the relative arrangement of the original individual fibril bundles in the untwisted yarn produced is of a purely arbitrary nature and changes with a random frequency, which on average is also dependent on the environmental or surrounding conditions during the production, together with production parameters such as e.g. the thread tension on bringing together or mixing. In the case of yarns formed from identical fibril bundles, the relative arrangement of the bundles is irrelevant, so that such a method is completely suitable for the production thereof. However, this is not the case with yarns made from differently colored or different dyeable bundles. The color effect of the finished products of such yarns is to a high degree dependent on the reciprocal arrangement of the fibril bundles and in particular the frequency of the changes. A very frequent change in the arrangement leads to a product acting in an almost monochromatic manner, whereas less frequent, irregular changes can lead to undesired strips and blotch-like phenomena.

As the color effect of the end product cannot be left to chance, efforts have been made to control the reciprocal arrangement of the fibril bundles in an untwisted yarn. For example, German patent 33 28 477 describes a method in which, with correspondingly arranged changing thread guides, the reciprocal arrangement of the fibril bundles on bringing together can be modified with a controllable, regular rhythm. This makes it possible to produce yarns with a regular and in particular reproducible color quality leading to regular fine or coarse mottled end products.

Color effects other than mottling and regular mixtures can be obtained with yarns in which the reciprocal arrangement of the different colored fibril bundles does not change, i.e. is kept constant during production. This is not possible with the aforementioned method. Thus, from yarns with a constant fibril bundle arrangement it is e.g. possible to produce end products with a shading dependent on the viewing angle or processing pattern, or end products with shaded front and rear surfaces.

Accordingly it is an object of the invention to provide a method and apparatus for producing yarns enabling the production of products with special novel color effects.

It is another object of the invention to be able to combine at least two bundles of continuous synthetic fibrils into an untwisted yarn in such a way that the reciprocal arrangement of the individual fibril bundles is always the same.

It is another object of the invention to be able to control and reproduce a degree of reciprocal mixing in boundary zones between individual fibril bundles formed into a yarn.

It is another object of the invention to provide a technique which is combinable with conventional processes for producing synthetic yarns in such a way that individual fibril bundles do not have to first be wound onto bobbins.

It is another object of the invention to provide an apparatus which can be installed in modular form into existing equipment for the continuous production of untwisted yarns.

Briefly, the invention provides a method comprising the steps of conveying a plurality of traveling fibril bundles from a plurality of spinnerets in strip form with the fibril bundles in juxtaposed relation, i.e., orientation, thereafter stretching the traveling fibril bundles while maintaining the juxtaposed relation of the fibril bundles and thereafter texturing the traveling fibril bundles while maintaining the juxtaposed relation of the fibril bundles.

In one embodiment, the traveling fibril bundles are oiled and thereafter combined prior to being stretched.

In another embodiment, a false twist is imparted to each traveling fibril bundle after oiling and before combining.

In still another embodiment, the fibril bundles are oiled, separated, subjected to an optional false twisting operation, combined and then separated prior to being stretched.

The apparatus includes a first oiling head for oiling a plurality of traveling fibril bundles disposed in juxtaposed relation, a thread guide for guiding the oiled fibril bundles in juxtaposed relation and a second oiling head for oiling the fibril bundles downstream of the thread guide relative to the direction of travel of the fibril bundles.

In one embodiment, the apparatus includes a plurality of pins between the first oiling head and the thread guide for separating the fibril bundles into spaced relation to each other. These pins may also serve to re-orient the fibril bundles from a plane parallel to the first oiling head into a plane perpendicular to the first oiling head.

In still another embodiment, a false twister may be disposed downstream of the second oiling head for imparting a false twist to each respective fibril bundle passing therethrough.

Figure 2A:
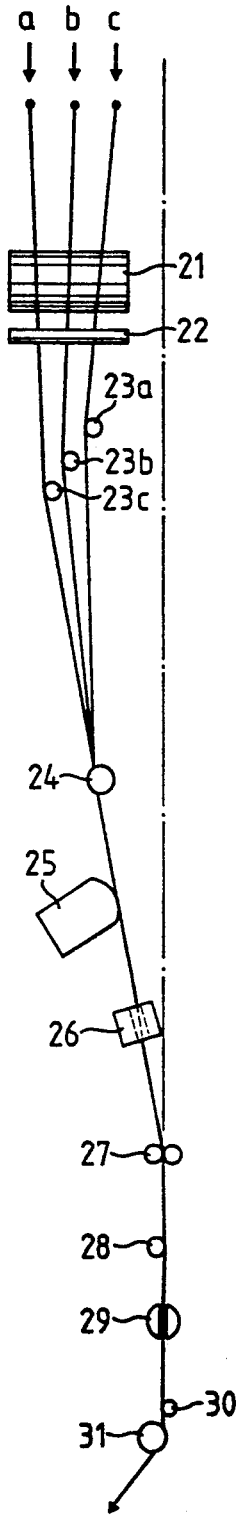
Figure 2B:
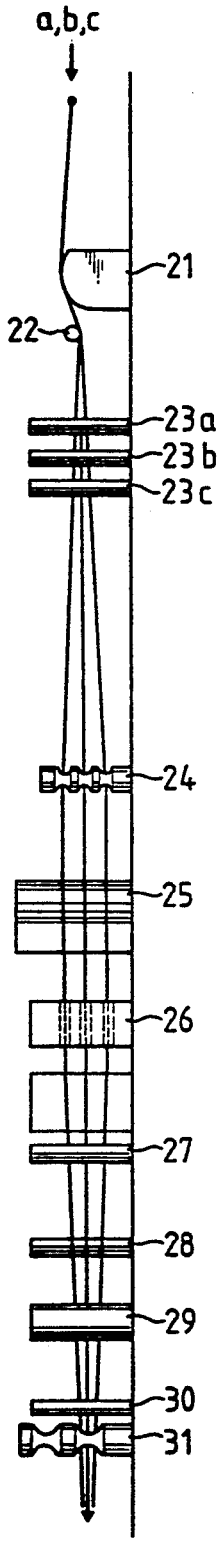

These and other objects and advantages of the invention will become more apparent from the following detailed description taken in conjunction with the accompanying drawings wherein:

FIG. 1 illustrates a schematic layout of an apparatus for the spinning, stretching, and texturizing of fibril bundles in accordance with the invention with variants thereof;

FIG. 2*a* schematically illustrates one embodiment for the processing of a plurality of fibril bundles between a spinning stage and stretching stage in accordance with the invention;

FIG. 2*b* illustrates a side view of the apparatus of FIG. 2*a;*

Figure 2C:
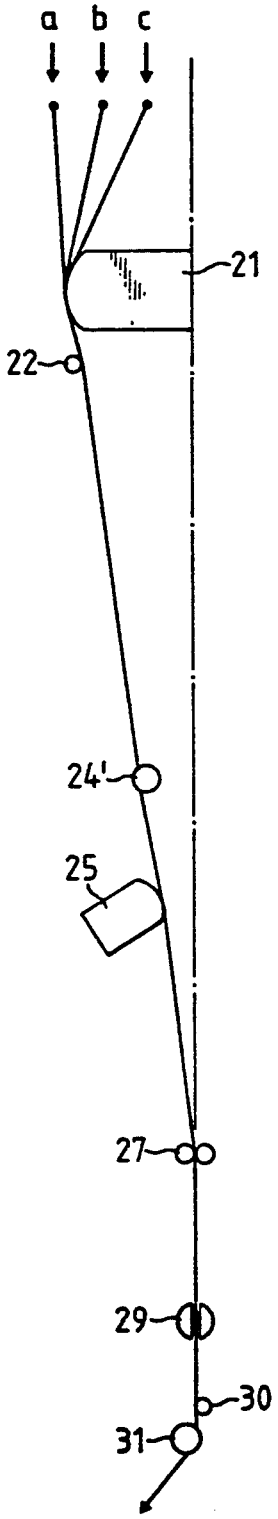
Figure 2D:
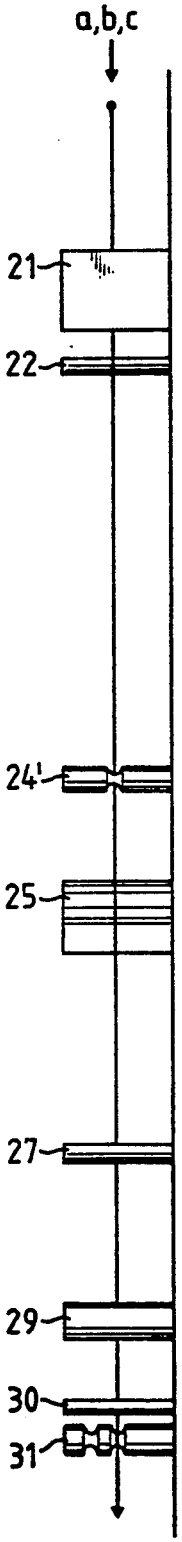

FIG. 2*c* illustrates a schematic view of a known apparatus for processing fibril bundles;

FIG. 2*d* illustrates a side view of the apparatus of FIG. 2*c;*

Figure 3A:
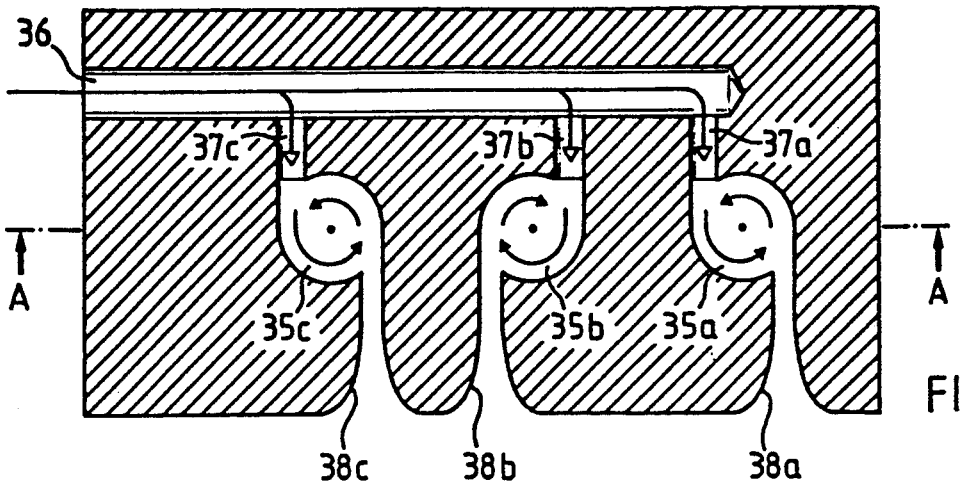
Figure 3B:
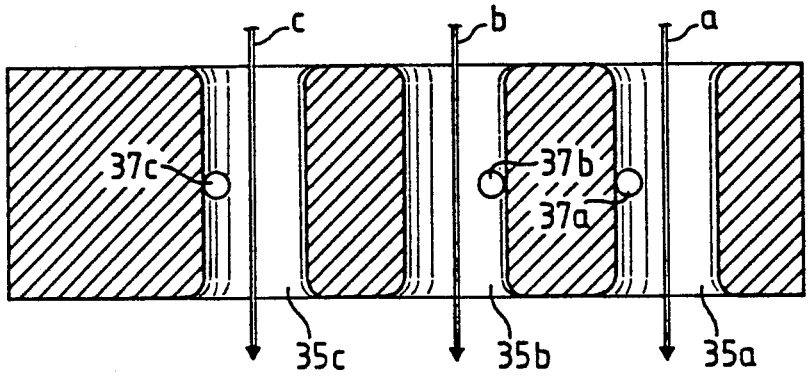

FIG. 3*a* illustrates a cross-sectional view of a false twister constructed in accordance with the invention;

FIG. 3*b* illustrates a cross-sectional view of the false twister taken on line A—A of FIG. 3*a;*

Figure 3C:
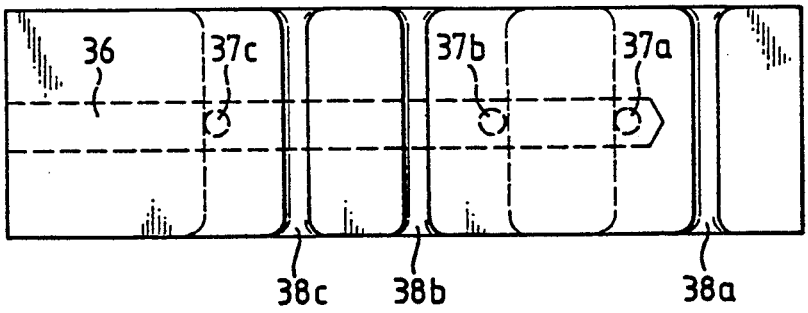

FIG. 3*c* illustrates a side view of the false twister of FIG. 3*a*; and

Figure 4:
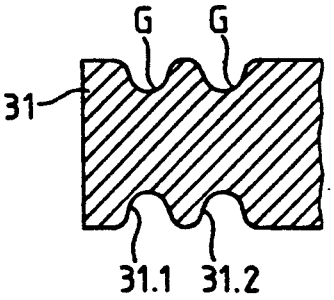

FIG. 4 illustrates a cross-sectional view of a thread guide for fibril bundles in accordance with the invention.

FIG. 1 shows the diagrammatic sequence of an untwisted yarn production method. The main method stages are spinning 11, stretching 12 and texturing 13, which are represented in the drawing by large, continuous line boxes. The intermediate method steps are represented by small, broken line boxes, above the main method steps for the standard prior art method and below the main method steps for the four inventive method variants.

According to the standard method the fibril bundles passing out of the spinnerets (not shown) which effect the spinning step are broadened in a method step 14.1 to form a fibril strip, in which the fibrils are juxtaposed to a greater or lesser extent and then oiled. In this method step no precautions are taken in order to separately guide the fibrils of the individual bundles and it is already possible for the bundles to become mixed. After oiling, the fibril strips are guided by means of a single-groove convergence thread guide (method step 17), the original fibril bundles being brought together or combined to form a thread and they thereby lose their identity. This is followed by a further oiling 14.2. The twice oiled and combined fibril bundles are in this form supplied to the stretching process 12. It is obvious that in such a method not only is the reciprocal arrangement of the individual bundles, but also the individual fibrils on entering the stretching process is of a purely random nature and can change in random intervals.

Variant I of the inventive method (in FIG. 1 the first line below the main method steps) provides for further intermediate method steps between spinning and stretching and all of these are aimed at keeping constant the reciprocal position of the fibril bundles and the reciprocal mixing of the fibrils of the individual bundles, so that the combined bundles supplied to the stretching process is not a mixture of the original individual bundles, but instead absolutely parallel guided individual bundles, whose fibrils are either not mixed or are reproducibly mixed in the boundary zones.

The first intermediate step 14.1 of the inventive method variant is, as in the standard method, a transforming of the fibril bundles into fibril strips and oiling. Through a corresponding strip guidance and a wide oiling surface, it is ensured that the individual strips are separately juxtaposed when moving. The oiling step 14.1 is followed by a separating step 15.1, in which the strips are so individually guided over separating pins, that they are again widened to form strips, which are rotated by 90° with respect to the strips in oiling step 14.1. A second oiling 14.2 with an oiling surface, which is at right angles to the oiling surface for oiling step 14.1, follows the separating step 15.1. The thus prepared and still separate fibril bundles are then passed through a false twisting stage 16. The bundles pass individually through round rings, where an air turbulence is produced by corresponding air circulation. As a result of this turbulence, the fibril bundles are subject to false twisting, which positions the individual fibrils in such a way that in subsequent method steps, where the individual bundles are guided in parallel, closely juxtaposed manner, they have a reduced tendency to mix with the fibrils of the bundle alongside them. This effect is intensified by opposing the rotation direction of the air turbulence for adjacent bundles. The subsequent mixing tendency of the fibrils can be controlled via the air flow intensity and quantity. The false twisting step 16 is followed by a bringing together or combining step 17, in which the previously separately guided fibril bundles converge in a thread guide groove to form an untwisted yarn. The thread guide, which brings together the individual strips is arranged in such a way and its groove created in such a way, that the strips come to rest in constant, juxtaposed manner. In this form, i.e. parallel, juxtaposed fibril bundles, which in no case intersect, which are not premixed at their contact faces and combined into a thread, the material is supplied to the stretching stage 12.

Variant I of the inventive method produces a yarn, which is characterized by a minimum mixing of the fibrils of the individual bundles in their contact zones. This produces clear color effects and finished products produced from such yarns are effectively perceived as polychromatic in the case of high color contrast between the individual bundles. If for gentler color effects, a mixing of the fibrils in the marginal zones of the individual bundles can be allowed, as stated, this can be brought about by a weaker air flow for the non-positively functioning false twister or, as shown in method variant II, by complete omission of the false twisting step 16. The effect of sharp color separation can also be increased in that following combination, the individual bundles are reseparated in further separating steps 15.2 prior to the stretching stage 12 and/or 15.3 between stretching 12 and texturing 13. Such method variants are shown as III and IV in FIG. 1.

FIG. 1 shows in exemplified manner four variants of the inventive method. Obviously, other arrangements of the method steps are possible, in that e.g. the fibril bundles are completely separately supplied to stretching 12 and only between stretching 12 and texturing 13 are brought together in a series of method intermediate steps 15.3.

FIG. 2 compares a variant of the inventive apparatus for performing method variant I (FIGS. 2*a* and 2*b*) and the standard apparatus for performing the standard method (FIGS. 2*c* and 2*d*). In both cases, a variant for three fibril bundles is shown. This can be appropriately modified for two or for more than three fibril bundles. It is also possible to homologously repeat the two represented arrangements with respect to the dot-dash line. That is to say, to groups of fibril bundles may be disposed in symmetric relation about a vertical axis and in a common plane with each group thereafter being reoriented into respective planes perpendicular to the common plane. Such arrangements make it possible to produce in each case two yarns from two or more fibril bundles. FIGS. 2*a* and 2*c* are viewed from a direction at right angles to the line in which the spinnerets are located, hereinafter called spinneret line for short, whilst FIGS. 2*b* and 2*d* are viewed from a direction parallel to said line.

The fibril bundles a, b and c pass out of corresponding spinnerets, which are arranged in a line. The spinneret line for FIGS. 2*a* and *c* is located in the paper plane and in FIGS. 2*b* and *d* at right angles thereto. The fibril bundles firstly pass over an oiling head 21 and a thread guide 22 constituted by a ceramic pin closely following the same. Through the passage of the bundles over the oiling head 21 and the thread guide 22, the bundles are broadened to form strips, in which the fibrils are juxtaposed to a greater or lesser extent. For method variant I (FIGS. 2*a* and *b*) the oiling head 21 and the thread guide 22 are parallel to the spinneret line and the oiling width is so large (e.g. 300 mm), that the individual bundles can be guided separately over the same. Following the thread guide each of the fibril bundles passes over a separating pin 23*a/b/c*, which is at right angles to the spinneret line. Thus, the fibril bundles initially pass parallel to the spinneret line between the thread guide 22 and the separating pins 23 and then come together to form bundles, so as to then be again broadened into strips at right angles to the spinneret line. Following the separating pins 23, the fibril bundles travel separately in the grooves of separating rolls 24. These bundles then pass through the thread oiler 25, whose oiling surface is at right angles to the spinneret line and over which the fibril bundles run separately. The oiler 25 is followed by the thread twister 26, to which further reference will be made in connection with FIG. 3. The fibril bundles pass separately through openings of the false twister 26 and as a result of the air turbulence in the openings are given a rotating effect, which is stopped against the spinnerets by the separating rolls 24 or the separating pins 23. The non-positively twisted bundles pass in juxtaposed manner between a pair of centering pins 27 and over a further separating pin 28, which acts as a twist stop in the direction counter to the stretching zone. This is followed by a thread cutter with a suction means 29. Following a further separating pin 30, the individual bundles are effectively combined in a groove of a thread guide 31. Further details will be given on the construction of the thread guide 31 in FIG. 4. From the thread guide 31, the thread combined from the three original fibril bundles is passed via corresponding roller arrangement to the stretching (drawing) stage.

For the standard variant (FIGS. 2*c* and *d*), the oiling head 21 and the thread guide 22 are at right angles to the spinneret line. As a result, the individual bundles come to rest in superimposed or randomly juxtaposed manner on the oiling head 21 and this gives a mixed strip, which is then guided directly on a single-groove convergence thread guide 24' which, as in method variant I, is followed by a thread oiler 25. The further elements of the apparatus in the thread direction are the same as for the apparatus of variant I, except for the fact that there is no false twister 26 and consequently no separating pin 28 stopping false twisting.

A comparison of the two apparatuses in FIG. 2 shows that they can be readily arranged in the same spatial conditions, i.e. existing means can be reequipped, or the inventive apparatus and the standard apparatus can be combined to form dismantlable modules and can be randomly interchanged.

FIG. 3*a* shows a section at right angles to the thread direction and FIG. 3*b* a corresponding section parallel to the thread direction through the false twister 26. The three fibril bundles a, b and c pass from top to bottom through three openings 35*a, b* and *c*. The openings are widened in a slightly funnel-shaped manner at the thread inlet and outlet, so that no sharp edge can damage the thread passing through. Air is blown into each opening from a central air supply bore 36 through an air duct 37*a/b/c* directed tangentially with respect to the opening (FIG. 3*c*). The thread introduction slots 38*a/b/c* through which the fibril bundles are introduced into the openings, also issue tangentially into the latter and also into the openings on the opposite side, so that they disturb the air turbulence or eddies to a minimum extent. The thread introduction slots 38*a/b/c* are widened against the outside of the twister 26, so that the fibril bundles can be effortlessly introduced into them. The direction of the air turbulence (indicated by arrows) is opposed in adjacent openings as a result of the corresponding arrangement of the air ducts 37*a/b/c* and the thread introduction slots 38*a/b/c*.

FIG. 4 shows a longitudinal section through the thread guide 31, which is in two-groove form, so that it can guide two yarns combined from, in each case, three fibril bundles. The grooves 31.1, 31.2 of the thread guide 31 are relatively wide and the bearing surface G for preventing the drawing apart of the thread is slightly concave (recessed), so that the individual fibril bundles are closely juxtaposed, but are not superimposed.

The additional separating steps 15.2 and 15.3 required for method variants III and IV are realized by conventional separating rolls, like rolls 24.

We claim:

1. A method of forming a yarn from a plurality of fibril bundles comprising the steps of conveying a plurality of travelling fibril bundles from a plurality of spinners in strip form with the fibril bundles in juxtaposed orientation;

thereafter false twisting each fibril bundle;

combining the false twisted fibril bundles together to form an untwisted yarn;

thereafter drawing the combined travelling fibril bundles while maintaining said juxtaposed orientation of the fibril bundles; and thereafter texturing the travelling fibril bundles while maintaining said juxtaposed orientation of the fibril bundles.

2. A method as set forth in claim 1 which further comprises the steps of oiling the fibril bundles prior to said step of false twisting the fibril bundles.

3. A method as set forth in claim 1 wherein said step of conveying includes moving a first plurality of fibril bundles in a common plane with a second plurality of fibril bundles disposed in symmetrical relation about a vertical axis and thereafter re-orienting each said plurality of fibril bundles into a respective second plane perpendicular to said common plane.

4. A method as set forth in claim 1 which further comprises the step of separating the travelling fibril bundles between said steps of drawing and texturing.

5. A method as set forth in claim 1 wherein said step of conveying includes moving the fibril bundles in a common plane and thereafter re-orienting the fibril bundles into a second plane perpendicular to said common plane, and which further comprises the step of oiling the fibril bundles in said second plane.

6. A method as set forth in claim 5 where the false twisting of the fibril bundles occurs with the fibril bundles in said second plane prior to drawing thereof.

7. A method as set forth in claim 6 wherein a false twist of opposite direction is imparted to adjacent fibril bundles.

8. A method for producing yarns, said method comprising the steps of conveying a plurality of travelling fibril bundles from a spinning stage in a common plane with the fibril bundles in juxtaposed orientation;

oiling the fibril bundles;

re-orienting the oiled fibril bundles into a second plane perpendicular to said common plane;

oiling the fibril bundles in said second plane; and thereafter combining the fibril bundles together to form an untwisted yarn for delivery to a drawing stage.

9. A method as set forth in claim 8 which further comprises the step of imparting a false twist to each travelling fibril bundle between said steps of oiling and combining the fibril bundles.

10. A method as set forth in claim 9 which further comprises the step of separating the combined false twisted fibril bundles prior to delivery to the drawing stage.

11. A method as set forth in claim 8 wherein said step of conveying includes moving a first plurality of fibril bundles in a common plane with a second plurality of fibril bundles disposed in symmetrical relation about a vertical axis and thereafter re-orienting each said plurality of fibril bundles into a respective second plane perpendicular to said common plane.

* * * * *